United States Patent [19]

Fang

[11] Patent Number: 4,798,320

[45] Date of Patent: Jan. 17, 1989

[54] CERAMIC-METAL BRAZED JOINT FOR TURBOCHARGERS

[75] Inventor: Ho T. Fang, Scottsdale, Ariz.

[73] Assignee: Allied-Signal Inc., Morristown, N.J.

[21] Appl. No.: 96,688

[22] Filed: Sep. 15, 1987

Related U.S. Application Data

[62] Division of Ser. No. 778,479, Sep. 20, 1985, Pat. No. 4,722,630.

[51] Int. Cl.[4] ..... B23K 1/12

[52] U.S. Cl. ..... 228/122; 228/124; 228/132; 228/165; 228/215; 29/156.8 R; 416/213 R; 403/30

[58] Field of Search ..... 228/122, 124, 128, 131, 228/132, 165, 168, 169, 176, 215, 56.3; 416/213 R, 241 B, 244 A; 29/156.8 R, 156.4 R; 403/30, 273

[56] References Cited

U.S. PATENT DOCUMENTS

| | | | |
|---|---|---|---|
| 4,610,934 | 9/1986 | Boecker et al. | 228/124 |
| 4,722,630 | 2/1988 | Fang | 228/165 |

FOREIGN PATENT DOCUMENTS

| | | | |
|---|---|---|---|
| 2734747 | 2/1979 | Fed. Rep. of Germany | 228/122 |
| 93606 | 6/1982 | Japan | 228/122 |
| 185541 | 10/1984 | Japan | 29/156.8 R |
| 82267 | 5/1985 | Japan | 228/263.12 |
| 141681 | 7/1985 | Japan | 228/263.12 |
| 155577 | 8/1985 | Japan | 228/122 |
| 260482 | 12/1985 | Japan | 228/263.12 |
| 533769 | 10/1976 | U.S.S.R. | 228/128 |

*Primary Examiner*—M. Jordan
*Assistant Examiner*—Samuel M. Heinrich
*Attorney, Agent, or Firm*—Ken C. Decker

[57] ABSTRACT

A rotor-shaft assembly which includes a ceramic, solid hubbed turbine rotor having an integral stub shaft brazed within one end of a generally cylindrically shaped sleeve member. A metal shaft is either brazed or cold press fitted within the other end of the sleeve member in a torque transmitting relationship. The stub shaft is formed with an annular relief therearound in order to reduce the compressive forces acting on the stub shaft by the sleeve member.

11 Claims, 3 Drawing Sheets

CERAMIC-METAL BRAZED JOINT FOR TURBOCHARGERS

CROSS-REFERENCE TO RELATED APPLICATIONS

This application is a division of my prior copending application, Ser. No. 778,479, filed on Sept. 20, 1985 and which is now U.S. Pat. No. 4,722,630.

TECHNICAL FIELD

The present invention relates to rotor-shaft assemblies of the type used in exhaust gas driven turbochargers, and more particularly to the method of attaching a ceramic rotor to a metal shaft assembly

BACKGROUND ART

One means of improving the response time of a turbocharger is to reduce the moment of inertia of the rotating parts by constructing the parts of lighter weight material, yet the material chosen must be able to withstand the harsh operating environment of the turbocharger. Since the air compressor impeller does not see high temperatures in comparison to the exhaust driven turbine wheel, designers began to construct the compressor impellers of low weight aluminum alloy which can survive in the turbocharger environment.

In order to further reduce the weight and therefore the moment of inertia of the rotor-shaft assembly, the industry focused on ceramics as a substitute to the relatively heavy steel superalloy turbine wheel. Ceramic substitutes are lightweight but able to survive the high temperatures and gaseous environment of the turbine. Once the decision has been made to use a ceramic turbine wheel, the focus of attention became the joint between the metal shaft and the ceramic turbine wheel as evidenced by U.S. Pat. Nos. 4,063,850; 4,125,344; and 4,424,003 and German Pat. No. 2,734,797. However, none of these efforts have resulted in a reliable joint as evidenced by the fact that there are few commercially available or production model ceramic turbine wheels on the market, whether it be in turbochargers or any other high speed rotating equipment. Several of these prior art structures teach to shrink fit the ceramic stub shaft of the turbine wheel within a metallic sleeve while others have concentrated on the use of adhesive in order to bond the two materials together.

Utilization of the shrink fit method of attachment gives rise to a further problem: the need to reduce the imposition of the high tensile stresses upon the ceramic stub shaft by the sudden discontinuity of contact between the sleeve member and ceramic rotor. The problem leads to the design feature of scheduling the compressive forces exerted by the sleeve onto the ceramic rotor by substantially tapering the thickness of the sleeve. This reduction in the thickness of the sleeve results in a reduction in the compressive stresses acting on the rotor and the tensile stresses imposed on the ceramic rotor at the point where the contact between the sleeve and rotor ends. It has been found that the tensile and shear stresses can cause the propagation of cracks in the ceramic rotor and eventually lead to joint failure.

Furthermore, the high temperature, thermal cycling atmosphere of the turbocharger leads to the degradation and failure of the ceramic rotor-metal shaft joint. Failures occur because of several reasons: the metal sleeve radially expands by a greater degree than the ceramic rotor due to the differential between the two materials' coefficient of thermal expansion thereby loosening the joint (thermal cycling causes "ratcheting", the easing out of the ceramic stub shaft from the sleeve during each cycle), and in the case of adhesives, the breakdown of the adhesive in the high temperature environment.

Thus, it should be apparent that there is a need in the art for an improved turbocharger design which utilizes a ceramic rotor joined to a metal shaft.

DISCLOSURE OF INVENTION

The present invention overcomes the disadvantages of the prior art as well as offering certain other advantages by providing a turbocharger having a ceramic rotor which is attached to a metal shaft via a metal sleeve to form a rotor-shaft assembly. The rotor-shaft assembly includes a metal sleeve member having a generally coaxial bore formed therethrough. One end of the sleeve extends generally radially outward to form a hub portion which defines an annular surface area generally coaxial to the shaft. The sleeve hub portion includes an annular groove which is sized to mate with a piston ring located within the center housing near the turbine end of the turbocharger. The ceramic rotor includes a hub and plurality of blades spaced about the circumference of the hub. The rotor further includes a stub shaft integral with and generally symmetrical about the axis of the hub. The stub shaft includes an annular relief therearound. The stub shaft is fitted within the end of the sleeve which defines the sleeve hub portion and the metal shaft is inserted into the other end of the sleeve. Between the ceramic stub shaft and the metal shaft is placed a predetermined amount of braze material. The assembly is heated, thereby melting the braze material which flows into any space between the sleeve and the ceramic stub shaft and metal shaft. Upon cooling, the braze material solidifies and joins the rotor to the shaft.

It is an object of the present invention to provide a ceramic to metal joint for use within a turbocharger. charger.

It is another object of this invention to provide a means for preventing lubricant from entering the turbine housing in the event of a joint failure or ceramic rotor failure.

It is another object of this invention to provide a method of attaching a ceramic shaft to a metal sleeve employing a fluxless brazing operation.

It is a further object to provide a low cost method of joining a ceramic rotor to a metal shaft.

For the purpose of illustrating the invention, there is shown in the drawings a form which is presently preferred. It being understood, however, that this invention is not limited to the precise arrangements shown.

BRIEF DESCRIPTION OF THE DRAWINGS

While this specification concludes with claims particularly pointing out the subject matter which is regarded as the invention, it is believed that the broader aspects of the invention, as well as the objects, features and advantages thereof may be better understood from the following detailed description of a preferred embodiment when taken in connection with the accompanying drawings in which:

BEST MODE FOR CARRYING OUT THE INVENTION

Figure 1:
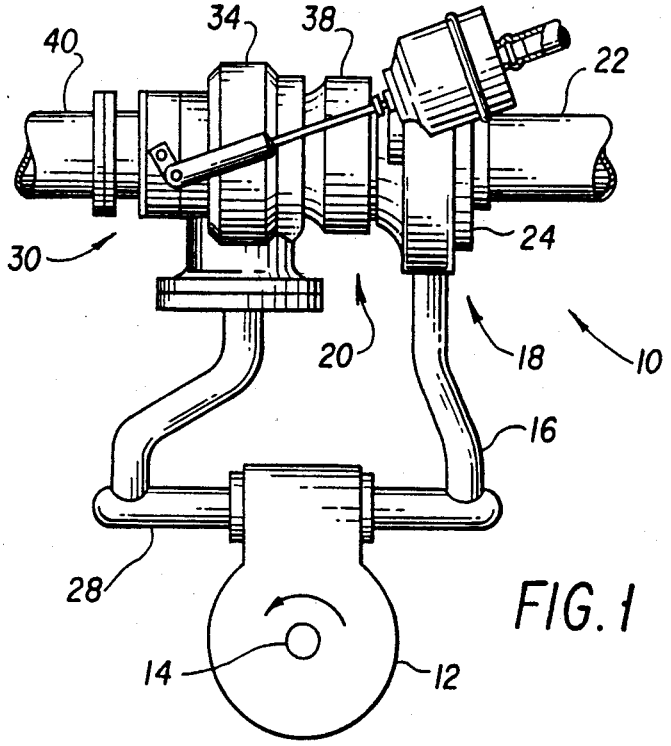
FIG. 1 is an illustration of a turbocharger of the type employing the present invention shown operably coupled to an internal combustion engine.
Figure 2:
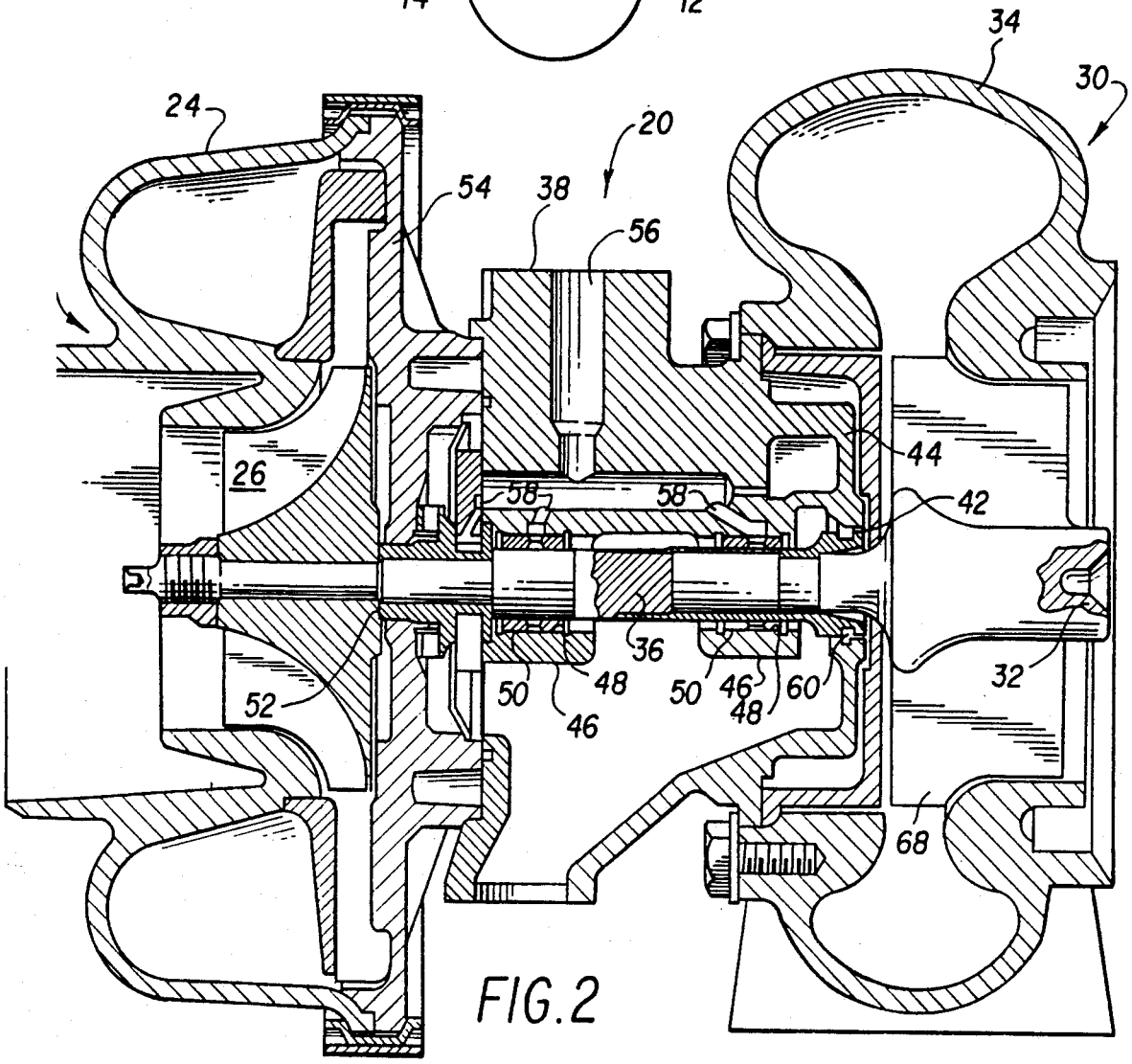
FIG. 2 is a cross-sectional view of a turbocharger of the type employing the preferred embodiment of the present invention.

A turbocharged engine system (10) is shown in FIGS. 1 and 2, and generally comprises a combustion engine (12), such as a gasoline or diesel powered internal combustion engine having a plurality of combustion cylinders (not shown), for rotatably driving an engine crankshaft (14). The engine includes an air intake conduit or manifold (16) through which air is supplied by means of a compressor (18) of the turbocharger (20). In operation the compressor (18) draws in ambient air through an air inlet (22) into a compressor housing (24) and compresses the air with a rotatable compressor impeller (26) to form so-called charge air for supply to the engine for combustion purposes.

Exhaust products are discharged from the engine through an exhaust conduit or manifold (28) for supply to a turbine (30) of the turbocharger (20). The high temperature (up to 1000° C.) exhaust gas rotatably drives a turbine wheel (32) within the turbine housing (34) at a relatively high rotational speed (up to 190,000 RPM) to correspondingly drive the compressor impeller (26) within the compressor housing (24). In this regard, the turbine wheel and compressor impeller are carried for simultaneous rotation on a common shaft (36) supported within a center housing (38). After driving communication with the turbine wheel (32), the exhaust gases are discharged from the turbocharger (20) to an exhaust outlet (40) which may conveniently include pollution or noise abatement equipment as desired.

The turbocharger, as is shown in FIG. 2 comprises the compressor impeller (26) rotatably connected to shaft (36) within the compressor housing (24). The shaft (36) extends from the impeller (26) through a center housing (38) and an opening (42) formed through the center housing wall (44) for connection to the turbine wheel 32 carried within the turbine housing (34). A compressor backplate (54) separates the center housing (38) and the impeller (26).

The center housing (38) includes a pair of bearing bosses (46) which are axially spaced from one another. The bearing bosses (46) form bearing bores (48) for reception of suitable journal bearings (50) for rotatably receiving and supporting the shaft (36). A thrust bearing assembly (52) is also carried about the shaft for preventing axial excursions of the shaft.

Lubricant such as engine oil or the like is supplied via the center housing (38) to the journal bearings (50) and to the thrust bearing assembly (52). A lubricant inlet port (56) is formed in the center housing (38) and is adapted for connection to a suitable source of lubricant such as filtered engine oil. The port (56) communicates with a network of internal supply passages (58) which are suitably formed in the center housing (38) to direct the lubricant to the appropriate bearings. The lubricant circulated to the bearings is collected in a suitable sump or drain for passage to appropriate filtering, cooling and recirculation equipment, all in a known manner. To provide against leakage of the lubricant from the center housing into the turbine housing, a seal or piston ring (60) is received within an annular groove in the surface of the side wall which defines the shaft opening (42).

Figure 3:
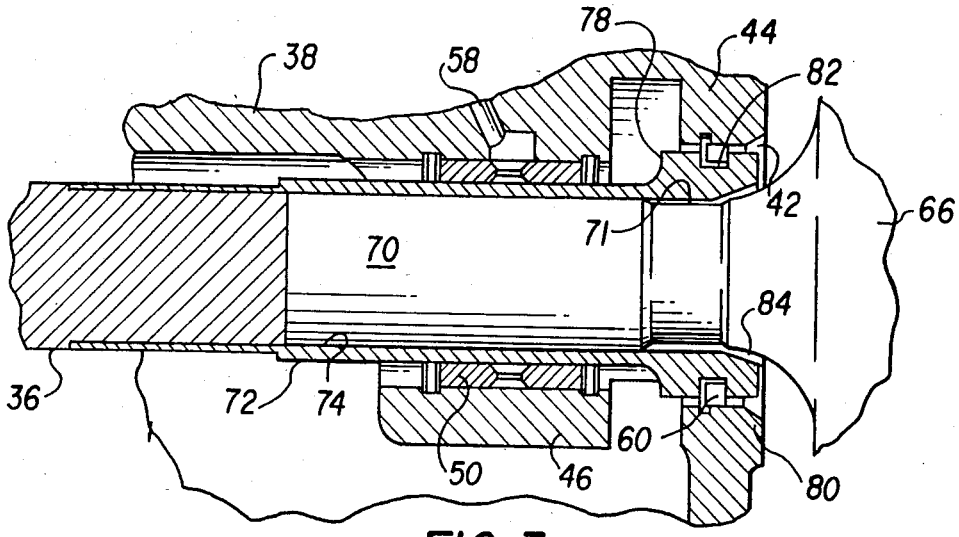
FIG. 3 is an enlarged, partial cross-sectional view of a portion of the turbocharger of FIG. 2.

The rotor-shaft assembly of the present invention is shown in FIGS. 2, 3 and 4 in its preferred form. The assembly includes a ceramic rotor, a metal sleeve member and a metal shaft. The ceramic rotor or ceramic turbine wheel (32) includes a hub (66) and a plurality of blades (68) periodically spaced about the circumference of the hub (66). The rotor (32) further includes a stub shaft (70) integral with and generally symmetrical about the axis of the hub (66). The stub shaft (70) includes an annular relief or undercut (71) on its surface and generally located between the hub (66) and the end of the stub shaft. The relief (71) is approximately 0.0015"-0.0030" in depth.

The metal sleeve member (72) is generally cylindrically shaped and includes a coaxial bore (74) therethrough which may be cast, machined or otherwise formed therein. As shown, the bore (74) has a constant diameter in that area which is in contact with the ceramic stub shaft, but a slight taper extending radially outward toward the other end (the outboard end referring to the end away from the middle of the object) can also be used.

At the outboard end of the sleeve member (72) is a generally radially outwardly extending hub portion (78) which defines an annular surface area (80) coaxial to the sleeve member (72). The annular surface (80) includes an annular piston ring groove (82) therein which is sized to operably mate with the piston ring (60) located within the center housing (38) of turbocharger (20). The incorporation of the hub section (78) and the piston ring groove (82) ensures that, if failure of the ceramic rotor occurs, the seal between the center housing (38) and the turbine housing (34) remains intact. Additionally, the seal (60) provides the normal function of sealing during separation.

Figure 4A:
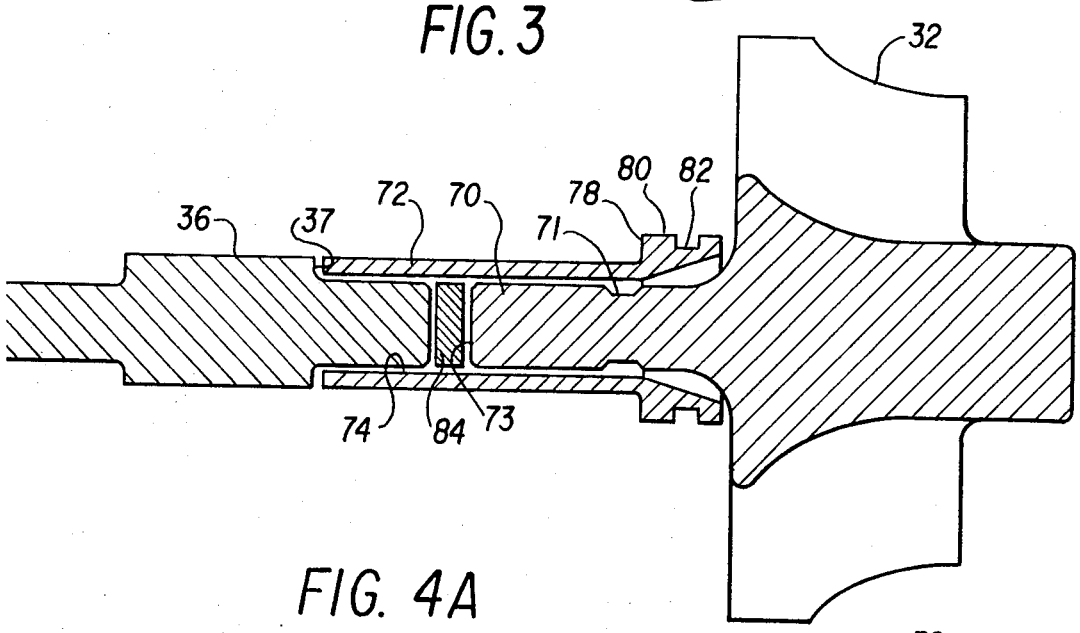
FIGS. 4A and 4B are cross-sectional views of the preferred ceramic rotor-metal shaft assembly as shown in FIGS. 2 and 3, with the areas to be filled with the braze alloy shown in exaggerated size to provide detail.

The joint is assembled by melting and solidifying a braze alloy (84) inside the joint. A predetermined amount of braze alloy (84) is placed between the ceramic stub shaft (70) and the end of metal shaft (36), as seen in FIG. 4*a*. When the joint area is heated up to the melting temperature, the braze alloy (84) fills the gaps between the sleeve member (72) and the ceramic stub shaft (70). At brazing temperature, the gap between the sleeve member (72) and the stub shaft (70) has expanded due to the higher thermal expansion coefficient of the sleeve member (72) compared to the ceramic. Upon cooling, the braze alloy solidifies and the sleeve member (72) tries to shrink back to the original shape at room temperature. The contraction of the sleeve member (72) exerts radial compressive force on the ceramic stub shaft (70) through the braze layer and joins the sleeve (72) to the ceramic stub shaft (70) and the shaft (36).

Relief (71) performs an important function: it acts to prevent the braze alloy from making its way into the area generally designated as A in FIG. 4. During the brazing operation, the melted braze alloy fills the gap between the ceramic stub shaft and the sleeve member due to capillary action. When the braze alloy enters the reservoir area created by relief, the capillary action is interrupted. Hence the braze alloy does not flow into area A, which ensures that the point at which the sleeve member exerts a compressive force on the ceramic stub shaft via the braze material is located within the area defined by the relief. This is important because it has been found that the compressive forces are greater in those areas where the metal sleeve is radially thicker and the gaps are narrowest, i.e. between the end of the stub shaft and relief (71) and in area A. While the discontinuity will be sudden, the compressive forces acting on the ceramic stub shaft in the relief area will not be as high as they would be if discontinuity occurred in area A. Since the spacing between the stub shaft and the sleeve member is increased by the relief, the compressive forces fall because of the amount and relative "softness" of the braze alloy in comparison to the Incoloy sleeve member. Hence, there is a scheduling of the compressive forces from its maximum to a minimum, which occurs in the area of relief (71).

As shown in FIG. 3, the assembled rotor-shaft assembly has been machined in order to prepare the outer diameter of the sleeve member and the shaft for close tolerance rotation within bearings (50).

Figure 4B:
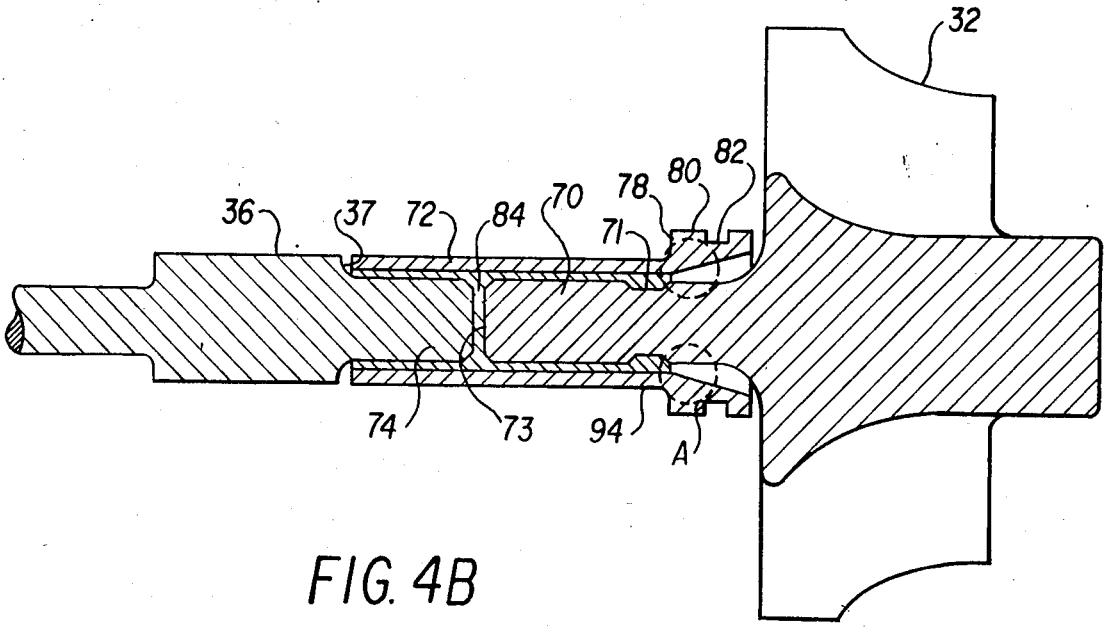

By way of example, a sleeve member made of Incoloy 903 was machined as shown in FIG. 4 having a constant bore diameter of 0.3160±0.0005 inch. The ceramic turbine wheel was formed with a stub shaft having a diameter of 0.31325±0.00025 inch. A predetermined amount of a braze alloy was placed within the joint as shown in FIG. 4*a*. Several braze alloys which have been successfully tested are Braze Nos. 45, 505, 716 and 720 available from Handy & Harman and "Ticusil" and "Cusil", available from GTE-WESGO. These braze alloys have melting temperatures ranging from 1150° to 1600° F. The type of braze alloy used depends on the ultimate temperature to which the assembly will be exposed. The joint was heated using an induction coil, raising the temperature of the braze material to above its melting temperature, at which point the braze alloy flows into the gaps between the sleeve member and both the stub shaft and the shaft. Upon cooling, the joint between the three pieces was formed as shown in FIG. 4*b*.

Figure 5:
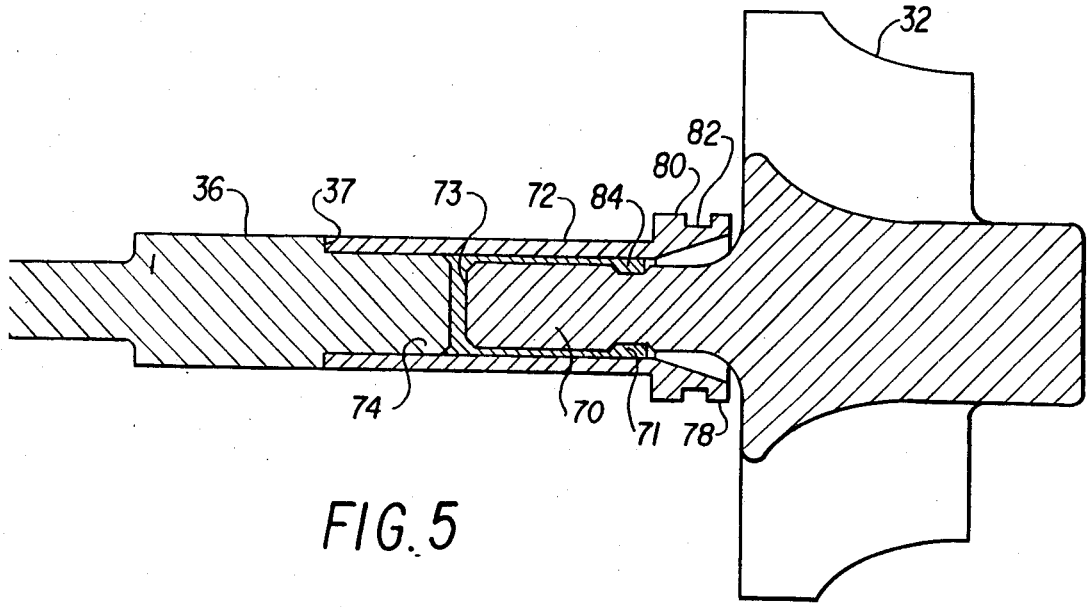
FIG. 5 is a cross-sectional view of an alternative ceramic rotor-metal shaft assembly, with the areas to be filled with the braze alloy shown in exaggerated size to provide detail.

An alternative rotor-shaft assembly is shown in FIG. 5. The assembly of FIG. 5 shows the turbocharger shaft (36) which has been cold press interference fitted within the inboard end of the sleeve member (72) before the brazing of the sleeve member (72) to the ceramic stub shaft (70) as described above. This alternative arrangement reduces the amount of braze alloy needed and the length of heating time. In order to accomplish cold pressing of the metal shaft within the sleeve, the shaft's diameter must be slightly larger than the bore in the sleeve.

A tolerance of ±0.00025 is sufficient for the cold press fitting of the metal turbocharger shaft (36) within the sleeve member (72). Furthermore, this metal to metal joint has good high temperature strength due to the higher thermal expansion coefficient of the 4140 steel used for shaft (36) than the Incoloy 903 sleeve member.

Figure 6:
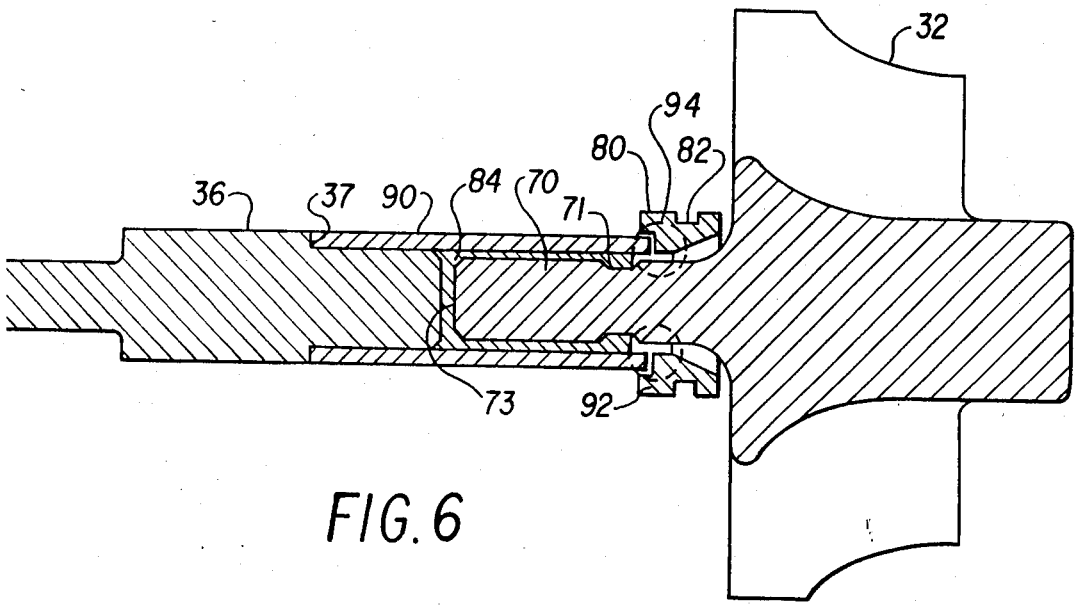
FIG. 6 is a cross-sectional view of another alternative ceramic rotor-metal shaft assembly, with the areas to be filled with the braze alloy shown in exaggerated size to provide detail.

An alternative feature is shown in FIG. 6 and includes a sleeve member (90) which is fabricated from Incoloy. A hub section (92) is made from a low cost, easy to machine alloy steel (for example, A151 4140 steel). The hub section (92) can either be brazed to the sleeve member (90) during the same brazing operation described above or pre-welded to the sleeve member by electron beam, laser or inertia welding.

In all applications, the sleeve member is located within the bearing (50) nearest the turbine end of the turbocharger. This placement assists in lessening the degree of thermal cycling experienced by the joint and in particular the braze alloy. While this is not of any particular concern when considering the joint between shaft (36) and sleeve member (72), because the compressive forces exerted on the shaft increase during use due to the difference in their respective coefficients of thermal expansion, it does affect the joint between the sleeve member (72) and ceramic shaft (70). At room temperature the coefficient of friction between the sleeve and ceramic stub shaft is high and the strength (tensile) of the braze alloy is at its maximum, thereby creating a reliable joint. Any temperature increase causes the metal sleeve to expand away from the ceramic stub shaft and tends to reduce the compressive force that held the joint together. However, the higher temperature also expands the braze alloy and increases the coefficient of friction between the braze metal and the ceramic shaft: the net effect being only a slight drop in joint strength. If exposed too high of operating temperatures, the braze alloy will soften rapidly or melt and the joint will fail. Hence, positioning of the sleeve within an oil cooled bearing is advantageous.

It is also possible to use a braze alloy containing "reactive" metal (e.g., titanium) to form some intermetallic compound between the braze alloy and the ceramic and to develop a chemical bond between the two. This additional bonding should increase the high temperature reliability of the joint.

According to the present invention, the rotorshaft assembly of the preferred embodiment is constructed by inserting the shaft (36) into the sleeve member (72) so that the shoulder (37) abuts the end of the sleeve member. A predetermined amount of solid braze alloy is placed atop the end of shaft (36) within sleeve member (72). The stub shaft (70) of the rotor (32) is placed within the other end of sleeve member (72). This workpiece is placed within an induction heating apparatus wherein, under an inert atmosphere (e.g., argon), the temperature is raised to a temperature above the melting temperature of the braze alloy. The melted braze alloy fills the gaps between the sleeve member and the stub shaft and metal shaft. Capillary action provides for flow upward into the gap between the sleeve and stub shaft. Gravitational forces seat the end of the stub shaft against the end of shaft (36) as the braze alloy melts. Thereafter, the assembly is allowed to cool to room temperature.

It is important to note that the following method of joining takes place within an inert atmosphere and without the use of a flux material. It has been found that the flux material coats the ceramic stub shaft during the brazing operation. Once the rotor-shaft is reheated, the flux layer on the ceramic stub shaft melts at a temperature well below the melting temperature of the braze alloy. This drastically reduces the coefficient of friction, allowing the stub shaft to be rotated in or withdrawn from the sleeve member.

Various modifications to the depicted and described apparatus and method will be apparent to those skilled in the art. Accordingly, the foregoing detailed description of the preferred embodiment of the invention should be considered exemplary in nature, and not as limiting to the scope and spirit of the invention a set forth in the appended claims.

What is claimed is:

1. The method of joining a ceramic stub shaft to a metal shaft to form a torque transmitting joint suitable for use in high speed machinery comprising the steps of:
   forming a bore through a metallic sleeve member:
   forming an annular relief about said stub shaft;
   placing the ceramic stub shaft into one end of said bore;
   placing a predetermined amount of braze alloy into the bore such that it abuts the stub shaft;
   placing the metal shaft into the other end of the bore such that the braze alloy is between the ceramic shaft and metal shaft;
   heating the area generally about the braze alloy until melting occurs;
   allowing the braze alloy to flow around the ceramic shaft into said annular relief; and
   allowing the braze alloy to cool.

2. The method according to claim 1 wherein the step of placing the metal shaft into the bore of the metallic sleeve member includes press fitting.

3. The method according to claim 1 wherein the step of forming an annular relief includes machining a circumferential groove to a depth of from about 0.0015" to about 0.0030" about said stub shaft.

4. The method according to claim 1 wherein the brazing operation takes place within an inert atmosphere and without the use of a flux material.

5. The method according to claim 1 wherein said braze alloy is provided with a reactive component to develop a chemical bond with the ceramic.

6. The method according to claim 1 further comprising the step of first welding a hub portion about one end of said sleeve member.

7. The method of reducing the compressive forces acting on a ceramic shaft by a surrounding sleeve member comprising the steps of:
   forming an annular relief about said ceramic shaft;
   brazing the sleeve member to said ceramic shaft such that only a portion of said relief is brazed to said sleeve member.

8. The method according to claim 7 wherein said annular relief is formed in a coaxial stub shaft integral with a ceramic rotor.

9. The method according to claim 7 further including the step of selecting a predetermined amount of braze material just sufficient to fill only a portion of said relief.

10. The method of joining a ceramic stub shaft to a metal shaft comprising the steps of:
   forming a bore through a sleeve member;
   cold press fitting the metal shaft into one end of said sleeve;
   placing a predetermined amount of braze alloy into said bore such that it abuts the shaft;
   placing the ceramic stub shaft into the open end of said bore;
   heating the are generally about the braze alloy until melting occurs;
   allowing the braze alloy to cool thereby rotatably joining the two shafts; and
   forming an annular relief in said ceramic shaft to contain some of said braze alloy.

11. The method according to claim 10 further including the step of selecting the material for the sleeve member and the metal shaft so that the thermal expansion coefficient of the shaft is greater than the sleeve member.

* * * * *